US010541493B1

(12) United States Patent
Stack et al.

(10) Patent No.: US 10,541,493 B1
(45) Date of Patent: Jan. 21, 2020

(54) FLEXING MOUNTING CLIP FOR AN ELECTRICAL ASSEMBLY

(71) Applicant: TE CONNECTIVITY CORPORATION, Berwyn, PA (US)

(72) Inventors: Daniel Franklin Stack, Kernersville, NC (US); Rohan Narang, High Point, NC (US); David Allen Klein, Kernersville, NC (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 16/043,897

(22) Filed: Jul. 24, 2018

(51) Int. Cl.
*H01R 13/639* (2006.01)
*H01R 13/40* (2006.01)
*H01R 13/74* (2006.01)

(52) U.S. Cl.
CPC ..... *H01R 13/639* (2013.01); *H01R 13/40* (2013.01); *H01R 13/745* (2013.01)

(58) Field of Classification Search
CPC .... H01R 13/639; H01R 13/40; H01R 13/746; H01R 13/73; H01R 13/74; H01R 13/745
USPC ..... 439/345, 544, 545, 550, 565
See application file for complete search history.

(56) References Cited

U.S. PATENT DOCUMENTS 2,461,487 A * 2/1949 Wagstaff ..... H01R 33/76 439/550
3,790,922 A * 2/1974 Normann ..... H01R 13/74 285/321
5,066,247 A * 11/1991 Watson ..... H01R 13/745 248/27.1
5,941,730 A * 8/1999 Uchiyama ..... F02M 37/10 439/550
6,637,538 B2 * 10/2003 Morykon ..... F16B 21/18 180/313
7,547,230 B1 6/2009 Strausser et al.
9,803,670 B2 * 10/2017 Wendt ..... F16B 2/22
9,899,777 B2 * 2/2018 Wendt ..... H01R 13/74
2016/0079706 A1 * 3/2016 Grudzewski ..... H01R 13/5202 439/345

(Continued)

FOREIGN PATENT DOCUMENTS

EP 0982814 A2 3/2000
EP 2337164 A1 6/2011

OTHER PUBLICATIONS

European Search Report dated Nov. 15, 2019 in corresponding European Application No. EP 19187049.2; total 8 pages.

*Primary Examiner* — Travis S Chambers
(74) *Attorney, Agent, or Firm* — Snell & Wilmer L.L.P.

(57) ABSTRACT

An electrical assembly includes a housing at a front side of a panel that extends between mating and receiving ends. The mating end extends through an opening of the panel from the front side to a rear side of the panel. A mounting clip extends between a front end and a rear end and includes a passage therethrough that receives the mating end of the housing. First and second sides of the body define the passage and includes a locking feature extending therefrom the first side into the passage. The clip moves between unlocked and locked positions by sliding the rear end of the clip along the rear side of the panel and the body is flexed outward to allow the locking feature to bypass the housing. The mating end of the housing is coupled with an electrical connector in a locking operation to secure the housing to the panel.

19 Claims, 7 Drawing Sheets

(56) References Cited

U.S. PATENT DOCUMENTS

2017/0133801 A1* 5/2017 Wendt ..... H01R 13/74

* cited by examiner

FLEXING MOUNTING CLIP FOR AN ELECTRICAL ASSEMBLY

BACKGROUND OF THE INVENTION

The subject matter herein relates generally to mounting clips for electrical assemblies.

Mounting clips are used in various system applications. For example, mounting clips are typically mounted to a panel or a circuit board. The mounting clip disposed on a first side of a panel receives a housing or a connector disposed on a second side of the panel and extending through the panel. However, known mounting clips are not without disadvantages. For instance, the mounting clips are typically designed with cantilevered latches for fastening the mounting clip to the housing. The cantilevered latches are subjected to stresses and strains during mating with the housing or when the housing is mated with the housing connecting components and are prone to damage in shipping. Additionally, the mounting clips may be damaged during shipping or handling. Furthermore, mounting clips are typically designed to have a large footprint that consumes space on the panel or circuit board, which may limit proximity of placement of other components to the connector.

A need remains for a mounting clip that may secure a mating component to a panel in a reliable manner.

BRIEF DESCRIPTION OF THE INVENTION

In one embodiment, an electrical assembly is provided including a housing disposed on a front side of a panel. The housing includes a housing body that extends along a mating axis between a mating end and a receiving end. The mating end extends through an opening of the panel from the front side of the panel to an opposite rear side of the panel. The electrical assembly also including a mounting clip that is coupled to the housing. The mounting clip includes a body extending between a front end and a rear end. The body including a passage therethrough that receives the mating end of the housing. The body including a first side and a second side defining the passage. The first side having a locking feature extending therefrom into the passage. The mounting clip is moveable between an unlocked position and a locked position by sliding the rear end of the mounting clip along the rear side of the panel. The body is flexed outward to allow the locking feature to bypass the housing as the mounting clip is moved between the unlocked position and the locked position. The mating end of the housing is coupled with an electrical connector on the rear side of the panel. The electrical connector engages with the housing in a locking operation such that the electrical connector secures the housing to the panel.

In another embodiment, a mounting clip is provided for securing a housing to a panel. The mounting clip including a body having a front end and a rear end with a passage extending therebetween. The body having a first side and a second side. The mounting clip also including a first locking feature extending from and into the passage. The mounting clip also including a second locking feature extending from the second side of the body and into the passage. The mounting clip is moveable between an unlocked position and a locked position by sliding the rear end of the mounting clip along a panel. The first and second locking features engage a housing in the locked position to secure the housing to the panel. The body is flexed outward to allow the first locking feature and the second locking feature to bypass the housing as the mounting clip is moved between the unlocked position and the locked position.

In a further embodiment, an electrical assembly is provided including a housing disposed on a front side of a panel. The housing includes a housing body that extends along a mating axis between a mating end and a receiving end. The mating end extends through an opening of the panel from the front side of the panel to an opposite rear side of the panel. The housing also including a first latching tab and a second latching tab. The electrical assembly also including a mounting clip that is coupled to the housing. The mounting clip having a body extending between a front end and a rear end. The body including a passage therethrough that receives the mating end of the housing. The body including a first side and a second side. The first side includes a first locking feature extending therefrom into the passage having a first pocket. The second side includes a second locking feature extending therefrom into the passage having a second pocket. The mounting clip is moveable between an unlocked position and a locked position by sliding the rear end of the mounting clip along the rear side of the panel in a single plane. The body is flexed outward to allow the first locking feature and the second locking feature to bypass the housing as the mounting clip is moved between the unlocked position and the locked position. The electrical assembly also including an electrical connector that is coupled with the mating end of the housing on the rear side of the panel. The electrical connector engages the housing in a locking operation such that the electrical connector secures the housing to the panel.

DETAILED DESCRIPTION OF THE INVENTION

Figure 1:
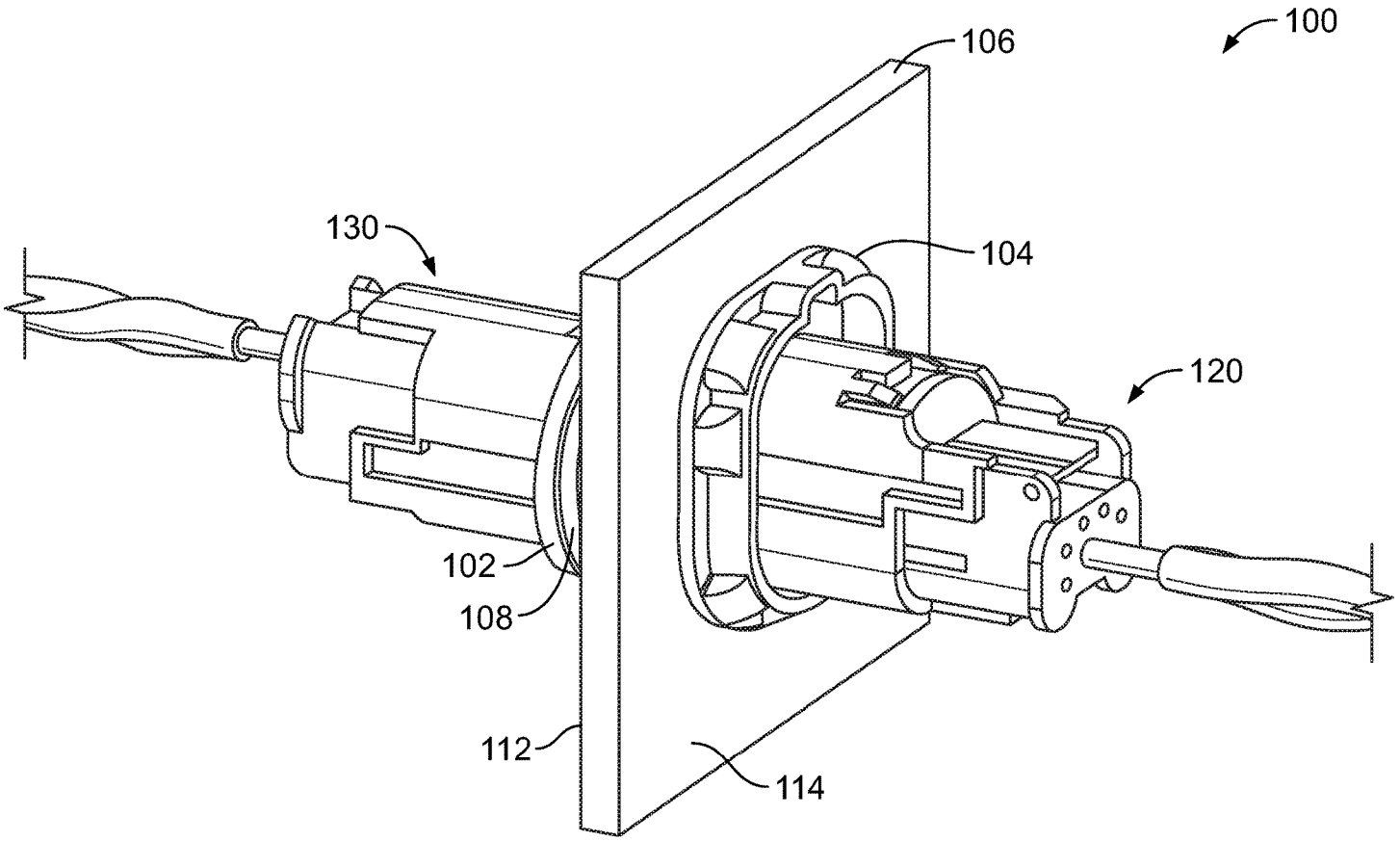
FIG. 1 is a perspective view of an electrical assembly in accordance with an exemplary embodiment.
Figure 2:
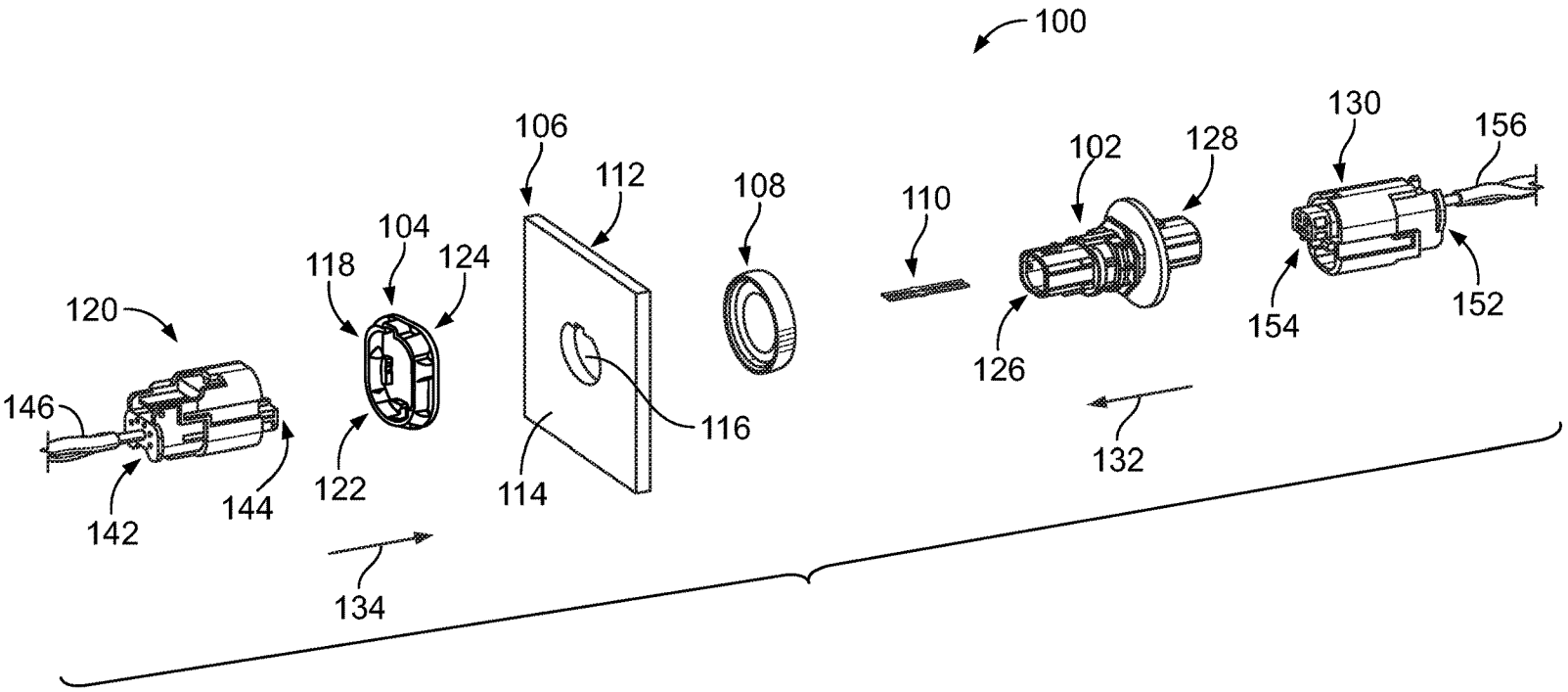
FIG. 2 is an exploded view of the electrical assembly in accordance with an exemplary embodiment.

FIG. 1 is a perspective view of an electrical assembly 100 in accordance with an exemplary embodiment. FIG. 2 is an exploded view of the electrical assembly 100. The electrical assembly 100 includes a housing 102 and a mounting clip 104 securing the housing 102 to a panel 106. The electrical assembly 100 is used to electrically connect to a first electrical connector 120 and/or a second electrical connector 130. In the illustrated embodiment, the electrical assembly 100 is used to electrically connect the first electrical connector 120 with the second electrical connector 130 on opposite sides of the panel 106.

The housing 102 includes a mating end 126 and a receiving end 128. The housing 102 is inserted into an opening 116 of the panel 106 that extends between a front side 112 and a rear side 114. For example, the panel 106 may be a plate, a circuit board, or any alternative surface. During assembly of the electrical assembly 100, the housing 102 is loaded into the panel 106 in a loading direction 132 such that the mating end 126 of the housing 102 extends through the opening 116 and extends a distance away from the rear side 114 of the panel.

The mounting clip 104 is disposed on the rear side 114 of the panel 106 and engages with the mating end 126 of the housing 102 to secure the housing 102 to the panel 106. The mounting clip 104 includes a body 118 that extends between a front end 122 and a rear end 124. The rear end 124 of the mounting clip 104 is disposed at the rear side 114 of the panel 106. When assembled, the mating end 126 of the housing 102 is received into the mounting clip 104 at the rear end 124 of the mounting clip 104. For example, the mounting clip 104 moves in a mounting direction 134 towards the rear side 114 of the panel 106 and engages with the mating end 126 of the housing 102. In alternative embodiments, the electrical assembly 100 may be devoid the housing 102, and the mounting clip 104 may alternatively engage with the second electrical connector 130 in order to secure the second electrical connector 130 to the panel 106. The mounting clip 104 and the housing 102 will be discussed in more detail below.

The mating end 126 of the housing 102 receives the first electrical connector 120 on the rear side 114 of the panel 106 and the receiving end 128 of the housing 102 receives the second electrical connector 130 on the front side 112 of the panel 106. The first electrical connector 120 includes a mating end 144 that engages with the mating end 126 of the housing 102 during the mating operation. The first electrical connector 120 includes a cable end 142 from which one or more electrical cables 146 protrude. The cables 146 may be terminated to electrical contacts (not shown) held within the first electrical connector 120. The second electrical connector 130 includes a mating end 154 that engages with the receiving end 128 of the housing 102 during the mating operation. The second electrical connector 130 includes a cable end 152 from which one or more electrical cables 156 protrude. The cables 156 may be terminated to electrical contacts (not shown) held within the second electrical connector 130. In the illustrated embodiment, the first and second electrical connectors 120, 130 are inline or linear connectors, such that the cable ends 142, 152 are opposite the mating ends 144, 154, respectively. Optionally, one or both of the first and second electrical connectors 120, 130 may be angled connectors, such as right angle connectors, 45 degree connectors, printed circuit board headers, or the like, that may or may not including the cables extending in varying directions relative to the mating end.

The electrical assembly 100 includes terminals 110 that are disposed inside the housing 102. The terminals 110 extend between the mating end 126 and the receiving end 128 of the housing 102. For example, the terminals 110 may be held within one or more channels inside the housing 102, may be held by clips or fasteners inside the housing 102, may be molded inside the housing 102, may be stitched with the housing 102, or the like. In the illustrated embodiment, the terminals 110 include pins at both mating ends, however the terminals 110 may have other mating interfaces at either or both ends in alternative embodiments.

The terminals 110 electrically connect the first electrical connector 120 with the second electrical connector 130. In the illustrated embodiment, the electrical assembly 100 includes two terminals 110. However, the assembly 100 may include any number of terminals 110 that may have any alternative shape and/or size such that the terminals 110 may electrically connect the first and second electrical connectors 120, 130 in alternative embodiments. Optionally, the assembly 100 may not include the terminals 110, but rather the first and second electrical connectors 120, 130 may be directly electrically connected through the housing. Optionally, the assembly 100 may include pin headers that may electrically connect the first and/or second electrical connectors to each other and/or with a circuit board.

As illustrated in FIG. 1, the first electrical connector 120 is electrically connected with the second electrical connector 130 via the terminals 110 disposed inside the housing 102. Alternatively, the electrical assembly 100 may be devoid the housing 102, and the first or the second electrical connector 120, 130 may extend through the opening 116 of the panel 106 and may be electrically connected to the other of the first or the second electrical connector 120, 130 on the front side 112 or the rear side 114 of the panel 106.

In an exemplary embodiment, the electrical assembly 100 includes a flange seal 108 that forms a seal between the housing 102 and the front side 112 of the panel 106. For example, the mating end 126 may extend through the flange seal 108 when the housing 102 is assembled to the front side 112 of the panel 106. In the illustrated embodiment the flange seal 108 has a circular cross-sectional shape, however the seal 108 may have any alternative shape and/or size. The flange seal 108 may be manufactured of a material such that the flange seal 108 forms an environmental seal between the housing 102 and the front side 112 of the panel 106. For example, the flange seal 108 may be manufactured of a non-conductive flexible rubber or plastic material. Optionally, the flange seal 108 may form an environmental seal between the housing 102 and the panel 106. For example, the flange seal 108 may be manufactured of conductive plastic, a dielectric elastomeric material, or the like.

In one or more embodiments, the electrical assembly 100 includes two or more flange seals 108 disposed at the front side 112 and/or the rear side 114 of the panel 106. For example, one or more flange seals 108 may be disposed between the mounting clip 104 and the first electrical connector 120, between the housing 102 and the second electrical connector 130, between the rear side 114 of the panel 108 and the mounting clip 104, or the like, in order to provide an environmental seal between two or more components of the electrical assembly 100. Optionally, a flange seal 108 may form a seal around the perimeter of the inside of the opening 116 of the panel 106. For example, a ring seal, such as an o-ring, or the like, may be positioned inside the opening 116 around the perimeter of the opening 116 between the front and rear sides 112, 114.

In one or more embodiments, the electrical assembly 100 may also include a spring (not shown) that may be disposed at the rear end 124 of the clip 104 and may engage with the rear side 114 of the panel 106. For example, a spring may be compressible between the rear end 124 of the clip 104 and the rear side 114 of the panel 106 to bias the mounting clip 104 away from the panel 106. The spring may be a wave spring, a leaf spring, a standard spring, a compression spring, a tension spring, or the like. The spring may be assembled with or attached to the clip 104 by a snap assembly, overmolding, riveting, heat staking, or the like.

Optionally, the electrical assembly 100 may include two or more springs disposed at the rear end 124 of the clip 104.

Figure 3:
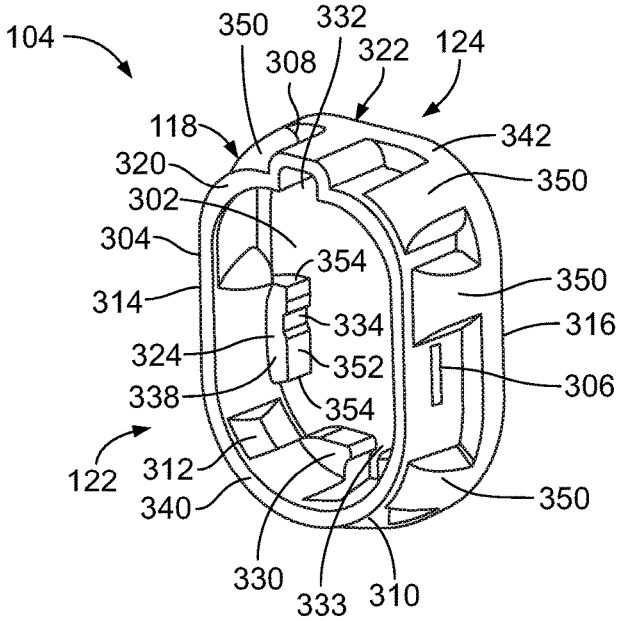
FIG. 3 is a perspective view of a mounting clip in accordance with an exemplary embodiment.

FIG. 3 is a perspective view of the mounting clip 104 in accordance with an exemplary embodiment. The mounting clip 104 includes a body 118 that extends between the front end 122 and the rear end 124 with a passage 302 extending therethrough. The body 118 includes a first side 304 and a second side 306. The first side 304 is opposite the second side 306. Optionally, the first and second sides 304, 306 may extend or be elongated in a direction such that the first side 304 is substantially parallel to the second side 306. In other various embodiments, the first or second sides 304, 306 may extend in one or more directions that may not be substantially parallel to the other of the first or second sides 304, 306. The first and second sides 304, 306 are connected by a top side 308 and a bottom side 310. Optionally, the top side 308 and/or the bottom side 310 may be curved. In various embodiments, the body 118 of the mounting clip 104 is in the shape of a ring, or an elongated ring, with the passage 302 extending therethrough. In the illustrated embodiment, the mounting clip 104 has a substantially elliptical cross-sectional shape. Optionally, the body 118 may have any alternative shape and/or size, may be devoid of the top or bottom sides 308, 310, or the like.

The front end 122 of the body 118 includes a front surface 320 that extends around the perimeter of the front end 122. In the illustrated embodiment, the front surface 320 is disposed at a substantially common distance away from the rear end 124 of the body 118 around the perimeter of the body 118. Optionally, the front surface 320 at the first and second sides 304, 306 may be disposed closer to or further away from the rear end 124 relative to the front surface 320 at the top side 308 and/or bottom side 310 of the body 118. Additionally, the rear end 124 of the body 118 includes a rear surface 322 that extends around the perimeter of the rear end 124. In the illustrated embodiment, the front surface 320 and the rear surface 322 are substantially planar surfaces. Optionally, the front surface 320 and/or the rear surface 322 may not be substantially planar. For example, the front surface 320 may be disposed at varying distances apart or away from the rear surface 322 around the perimeter of the body 118, or any combination therein.

Figure 5:
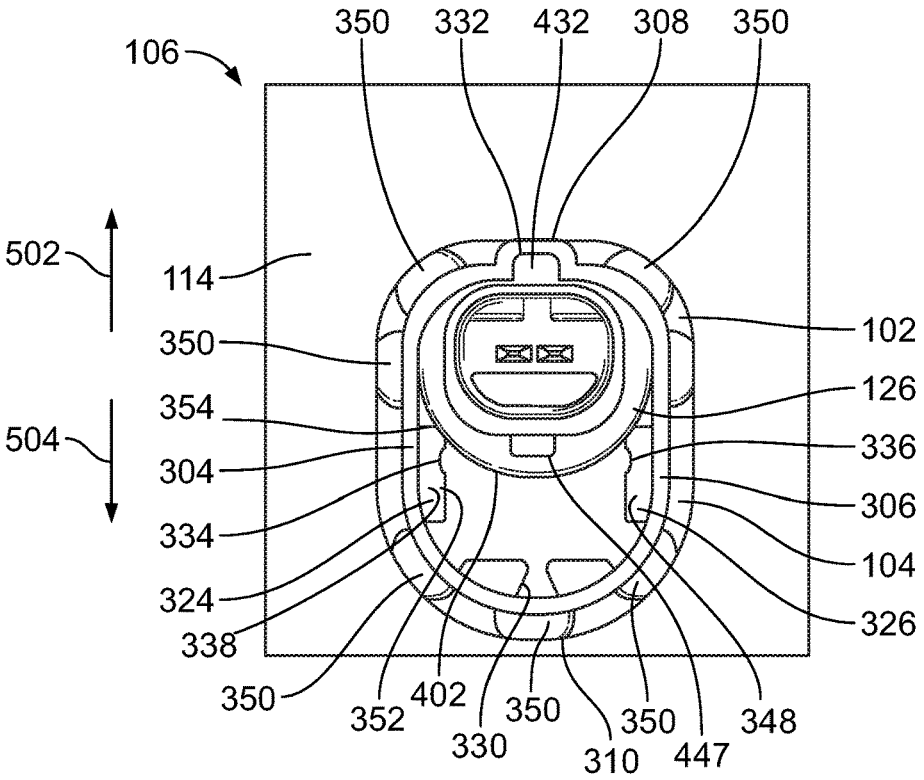
FIG. 5 is a front view of the mounting clip in an unlocked position in accordance with an exemplary embodiment.
Figure 6:
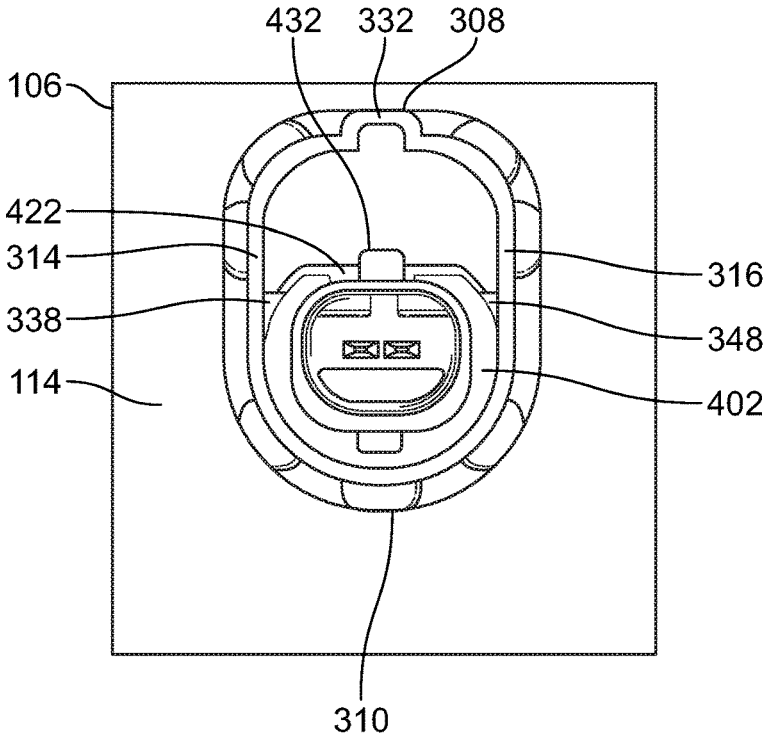
FIG. 6 is a front view of the mounting clip in a locked position in accordance with an exemplary embodiment.

The front surface 320 at the front end 122 includes a ring 340 that extends around the passage 302 of the mounting clip 104. The mounting clip 104 includes a flange 342 at the rear end 124 of the mounting clip 104 that extends around the passage 302 and extends from the ring 340. For example, the flange 342 extends a distance away from the body 118 of the mounting clip 104 around the perimeter of the mounting clip 104. The mounting clip 104 includes load distributors 350 that extend between the ring 340 and the flange 342. The load distributors 350 are shaped and sized to distribute the loading force of the latching or mounting action substantially evenly around the perimeter of the mounting clip 104. For example, the load distributors 350 allow for easier bending or flexing of the mounting clip 104 relative to a bending or flexing of the flange 342. In the illustrated embodiment (and as seen in FIGS. 5 and 6), the clip 104 includes seven load distributors that are disposed around the perimeter of the mounting clip 104 near the top side 308 and the bottom side 310, and does not include load distributors at the first or second sides 304, 306. Optionally, the clip 104 may include any number of load distributors 350 disposed at any position about the perimeter of the mounting clip 104 and the load distributors 350 may have any alternative shape and/or size. Optionally, the mounting clip 104 may have an alternative stiffening or strengthening feature or structure coupled with or unitarily formed with the body 118 such that the load distributors 350 or strengthening feature may distribute a bending force or latching force substantially evenly around the perimeter of the mounting clip 104.

The mounting clip 104 includes an alignment notch 332 that is disposed at the top side 308 of the mounting clip 104 and an alignment notch 333 that is disposed at the bottom side 310 of the mounting clip 104. The alignment notch 332 is shaped and sized such that the alignment notch 332 aligns with reciprocating alignment notches 432, 434 (illustrated in FIGS. 4 and 5) of the housing 102. The alignment notch 333 is shaped and sized such that the alignment notch 333 aligns with a reciprocating alignment notch (not shown) of the housing 102 and allows the alignment notch of the housing 102 to pass through the mounting clip 104. For example, the alignment notches 332, 333 of the mounting clip 104 orient the mounting clip 104 with respect to the housing 102 when the mounting clip 104 is coupled with the housing 102. Optionally, the mounting clip 104 may include any number of alignment notches or other types of alignment features.

The mounting clip 104 also includes an anti-rotation feature 330. In the illustrated embodiment, the anti-rotation feature 330 is disposed near the bottom side 310 of the mounting clip 104 and engages with a protrusion (not shown) of the housing 102. The anti-rotation feature 330 extends into the passage 302 a distance away from the interior surface 312 of the mounting clip 104 and engages with the housing 102. For example, the anti-rotation feature 330 prohibits the mounting clip 104 from rotating relative to the panel 106 when the mounting clip 104 is coupled with the housing 102. Alternatively, the anti-rotation feature 330 may have any alternative shape and/or size, may be disposed at any alternative position on the mounting clip 104, may be disposed on the housing 102, or the like.

The mounting clip 104 includes the first side 304 of the clip 104 and the second side 306 of the clip 104. The first side 304 and the second side 306, along with the top and bottom sides 308, 310, define the passage 302 that extends through the clip 104 between the front end 122 and the rear end 124 of the clip 104. Illustrated in FIGS. 3 and 5, the first side 304 includes a first locking feature 324 that extends away from the first side 304 and into the passage 302. Similarly, the second side 306 includes a second locking feature 326 that extends away from the second side 306 and into the passage 302. The first and second locking features 324, 326 each include two long sides 352, two short sides 354, and a front surface or locking surface 338 that is disposed facing towards the front end 122 of the clip 104. The short sides 354 may also be referred to as top and bottom sides of the locking features 324, 326, and the long sides may also be referred to as interior and exterior sides of the locking features 324, 326. For example, the first and second locking features 324, 326 have a substantially rectangular shape. The locking features 324, 326 are connected to an interior surface 312 of the mounting clip 104 by the long sides 352 and extend into the passage by the length of the short sides 354. For example, the longer dimension of the long sides 352 of each of the locking features 324, 326 extends along the interior surface 312 and the shorter dimension of the short sides 354, relative to the longer dimension of the long sides 352, extends a distance into the passage 302 and away from the interior surface 312 of the mounting clip 104.

The first locking feature 324 includes a first pocket 334 that is disposed on the long side 352 of the locking feature 324. Additionally, the second locking feature 326 includes a second pocket 336 that is disposed on the long side 352 of the second locking feature 326 (illustrated in FIG. 5). In the illustrated embodiment, the first and second pockets 334, 336 are recesses that extend into the long sides 352 of each locking feature 324, 326 and extend into each locking feature 324, 326. The first and second pockets 334, 336 are shaped and sized in order to maintain a position of the housing 102 inside the mounting clip 104. The first and second pockets 334, 336 will be described in more detail below.

Figure 4:
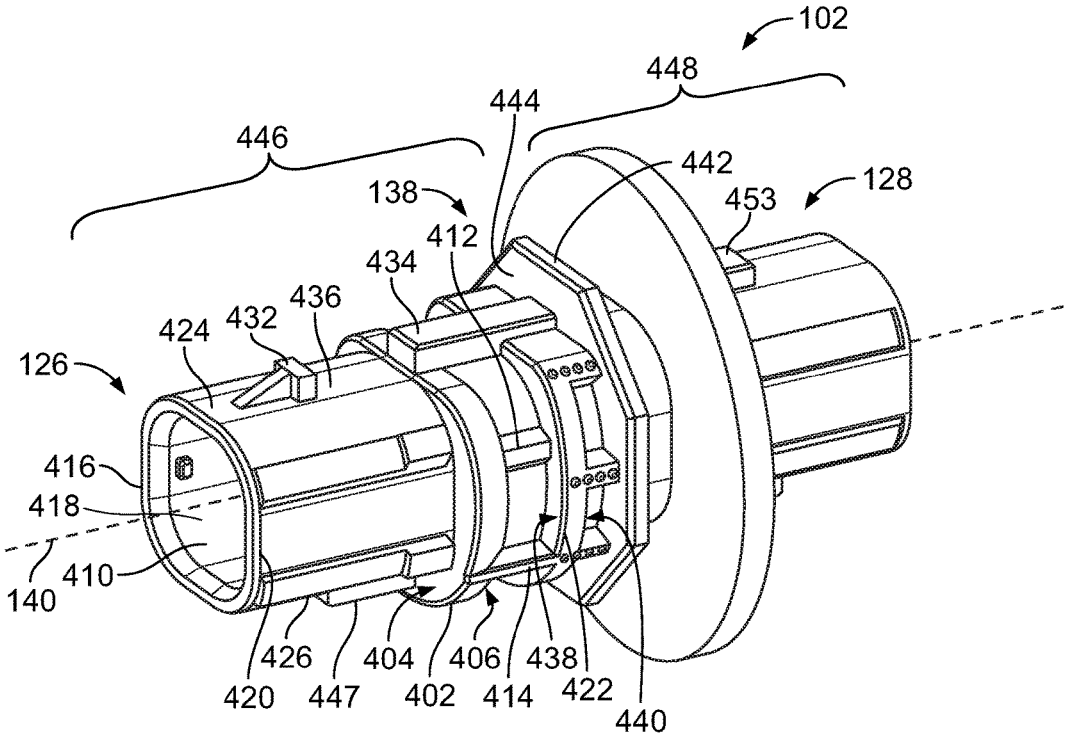
FIG. 4 is a perspective view of a housing in accordance with an exemplary embodiment.

FIG. 4 is a perspective view of the housing 102 in accordance with an exemplary embodiment. The housing 102 has a housing body 138 that extends from the mating end 126 to the receiving end 128 along a mating axis 140. The housing body 138 also includes a first side 416 and a second side 420 that are connected by a top side 424 and a bottom side 426. In the illustrated embodiment, the housing 102 includes an interior surface 418 defining a channel 410 that is disposed at the mating end 126 and extends into the body 138 of the housing 102. The channel 410 may extend at least a part of a distance inside the housing 102 towards the receiving end 128. Optionally, the housing 102 may include any number of channels or passages extending any distance between the mating end 126 and the receiving end 128, and may include electrical contacts, wires, fasteners, locking features, or the like, disposed inside the housing 102, such as the terminals 110, that may electrically connect the first electrical connector 120 with the second electrical connector 130 (illustrated in FIGS. 1 and 2) or may connect the first connector 120 to a printed circuit board (not shown).

The alignment notches 432, 434 or alignment protrusions are disposed at the top side 424 of the housing 102 and engage with the alignment notch 332 of the mounting clip 104 when the mounting clip 104 is coupled with the housing 102. The alignment notches 432, 434 may be negative shapes, such as grooves, or positive shapes, such as bumps, and the corresponding alignment notch 332 of the mounting clip 104 may have a mating male or female corresponding shape. In the illustrated embodiment, the alignment notches 432, 434 are separated from each other in a direction along the mating axis 140 by a channel 436. For example, the alignment notch 432 may double as an alignment feature to align the mounting clip 104 with the housing 102 and as a latching feature to latch the first electrical connector 120 to the housing 102 in a locking operation. Optionally, the housing 102 may include a single alignment notch that extends along the top side 424 of the housing 102 or any other side or bottom of the housing 102 that may align the housing 102 with the mounting clip 104 and may latch the first electrical connector 120 to the housing 102.

The housing 102 also includes an alignment notch 447 on the bottom side 426 and an alignment notch 453 on the top side 424. The notch 447 engages with an alignment notch or an anti-rotation feature of the first electrical connector 120 (not shown) when the first electrical connector 120 is coupled with the housing 102. Additionally, the notch 453 engages with an alignment notch or an anti-rotation feature of the second electrical connector 130 when the second electrical connector 130 is coupled with the housing 102.

The alignment notches 432, 434 at the top side 424 of the housing 102 orient the housing 102 with respect to the opening 116 of the panel 106 and orient the mounting clip 104 with respect to the housing 102. The alignment notches 432, 453 at the top side 424 of the housing 102 and the alignment notch 447 at the bottom side 426 of the housing 102 orient the housing 102 with respect to the second electrical connector 130 and the first electrical connector 120, respectively. Optionally, the housing 102, the mounting clip 104, the opening 116 of the panel 106, the first electrical connector 120, and/or the second electrical connector 130 may include any alternative alignment features having any alternative shape and/or size.

The housing 102 also includes a first flange 402 and a second flange 422. The first flange 402 is disposed closer to the mating end 126 of the housing 102 than the second flange 422. The first flange 402 includes a front surface 404 and a rear surface 406. Similarly, the second flange 422 includes a front surface 438 and a rear surface 440. The first and second flanges 402, 422 extend around the perimeter of the body 138 of the housing 102 about the mating axis 140. The housing 102 includes latching tabs 412 and blocking tabs 414 disposed on the first and second sides 416, 420 of the body 138 and are elongated in a direction along the mating axis 140 between the first and second flanges 402, 422. The latching tabs 412 are disposed between the top side 424 and the blocking tabs 414.

The housing 102 includes a mating section 446 and a receiving section 448 between the mating end 126 and the receiving end 128. The mating section 446 extends between the mating end 126 and a mating surface 444 of a third flange 442. For example, the mating section 446 includes at least the alignment notches 432, 434, the first and second flanges 402, 422, the latching tabs 412, and the blocking tabs 414. In the illustrated embodiment, the mating section 446 has a width or size that is less than the width or size of the opening 116 of the panel 106. For example, the mating section 446 of the housing 102 has a shape and size that allows the mating section 446 to extend through the opening 116 of the panel 106. The housing 102 may also include one or more crush bumps or features that may interfere with the opening 116 of the panel 106 to provide a tight or press fit between the housing 102 and the opening 116. Additionally, the mating section 446 has a width or size that is less than a width or size of the passage 302 of the mounting clip 104. For example, the mating section 446 is sized in order to be received within the passage 302 of the clip 104.

The receiving section 448 extends between the flange 442 and the receiving end 128 along the mating axis 140. When the housing 102 is coupled with the panel 106, the mating section 446 (from the mating end 126 to the mating surface 444) extends through the opening 116 of the panel 106 from the front side 112 to the rear side 114, and the receiving section 448 remains on the front side 112 of the panel 106. The third flange 442 has a shape and size that prohibits the receiving section 448 from extending through the opening 116 when the housing 102 is coupled with the panel 106 in the loading direction 132 from the front side 112 to the rear side 114 (of FIG. 2).

FIG. 5 is a front view of the mounting clip 104 in an unlocked position in accordance with an exemplary embodiment. The mounting clip 104 is moved in the mounting direction 134 (of FIG. 2) in order to engage with the mating end 126 of the housing 102 that extends from the rear side 114 of the panel 106. The alignment notch 332 of the mounting clip 104 is aligned with the alignment notches 432, 434 of the housing 102 in order to orient the mounting clip 104 with respect to the housing 102.

The first side 304 of the clip 104 includes the first locking feature 324 that extends into the passage 302 of the clip 104. Additionally, the second side 306 of the clip 104 includes the second locking feature 326 that extends into the passage 302 of the clip 104. In the illustrated embodiment, the first locking feature 324 is substantially mirrored with the second locking feature 326 about a vertical general centerline (not shown) of the mounting clip 104. Optionally, the first or second locking features 324, 326 may have a unique shape and/or size, may be disposed at any alternative position of the mounting clip 104, may extend a distance further or less than a distance of the other first or second locking feature 324, 326 into the passage, or the like. The first locking feature 324 includes the first pocket 334 and the locking surface 338 that is planar to and faces in a direction towards the front end 122 of the clip 104. The second locking feature 326 includes the second pocket 336 and a front surface or locking surface 348 that is planar to and faces in a direction towards the front end 122 of the clip 104.

Illustrated in FIG. 5, the mounting clip 104 is in an unlocked position. For example, when the mounting clip 104 is in the unlocked position, the mating end 126 of the housing 102 is able to move in and/or out of the opening 116 of the panel 106 (e.g., move in the loading direction 132 of FIG. 2). FIG. 6 is a front view of the mounting clip 104 in a locked position. The mounting clip 104 in the locked position maintains a position of the housing 102 to the panel 106. When the mounting clip 104 is in the locked position, the mating end 126 of the housing 102 is coupled with the first electrical connector 120 and the receiving end 128 of the housing 102 is coupled with the second electrical connector 130. For example, when the mounting clip 104 is in the locked position and the first and second electrical connectors 120, 130 are coupled with the housing 102, the mounting clip 104 and the housing 102 are not able to move away from the panel 106. The first electrical connector 120 engages the mating end 126 of the housing 102 in a first locking operation. For example, the first electrical connector 120 secures the housing 102 and the mounting clip 104 to the panel 106. The second electrical connector 130 engages the receiving end 128 of the housing 102 in a second locking operation. Alternatively, the receiving end 128 of the housing 102 may be coupled with an alternative connector, circuit board, electrical port, or the like.

The mounting clip 104 is moveable between the unlocked position and the locked position by assembling or disassembling the first electrical connector 120 and sliding the rear end 124 of the mounting clip 104 along the rear side 114 of the panel 106. For example, the locking features 324, 326 may provide a primary locking or retention force that maintains a position of the mounting clip 104 in the unlocked or locked positions, and the first electrical connector 120 may provide a secondary locking or retention force that is greater than the primary locking force. In the illustrated embodiment, the mounting clip 104 is moveable by sliding the clip 104 in a linear direction 502 to move the clip 104 to the locked position. The linear direction 502 is substantially perpendicular to the mating axis 140 of the housing 102. Optionally, the mounting clip 104 may move in a direction that is radial to the mating axis 140. Additionally, the clip 104 is moveable by sliding the clip 104 in a linear direction 504 (e.g., that is opposite the direction 502) to move the clip 104 to the unlocked position. For example, the mating end 126 of the housing 102 and the passage 302 of the mounting clip 104 are sized and shaped to allow the clip 104 to move by translating the clip 104 in the linear directions 502, 504 when the mating end 126 is received within the passage 302.

Additionally, the clip 104 may be moved between the unlocked and locked positions in a single or common plane. For example, the mounting clip 104 may move between the unlocked and locked positions by sliding the mounting clip 104 along the panel 106 while the rear end 124 of the clip 104 remains in contact with the panel 106. In one or more embodiments, the mounting clip 104 may be moved between the unlocked and locked positions without disrupting a position of the housing 102 and/or while reducing an amount of stress that may be applied onto a solder joint of the housing 102 by the translation of the mounting clip 104.

When the mounting clip 104 is moved from the unlocked position to the locked position, the first and second locking features 324, 326 engage with the housing 102 to secure the housing 102 to the panel 106. The body 118 of the mounting clip 104 flexes, bends, expands, or the like, outward to allow the first and second locking features 324, 326 to bypass the housing 102 as the clip 104 is moved between the unlocked and the locked positions. In the illustrated embodiment, the mounting clip 104 is shaped and sized such that the features of the mounting clip 104 may shift positions (e.g., flex, bend, or the like), due to the flexibility of the mounting clip 104, when the mounting clip 104 moves between the unlocked and locked positions. For example, the load distributors 350 may redistribute flexing or bending forces of the mounting clip 104 in order for the flexing or bending forces to be substantially evenly distributed around the perimeter of the mounting clip 104. The area of the mounting clip 104 with the load distributors 350 may tend to flex or expand as the mounting clip 104 is moved between the unlocked and locked position.

When the mounting clip 104 is coupled to the mating end 126 of the housing 102 on the rear side 114 of the panel 106, the first and second locking features 324, 326 are disposed between the first and second flanges 402, 422 of the housing 102. For example, as the clip 104 moves between the locked position and the unlocked position, the locking surface 338 of the first locking feature 324 and the locking surface 348 of the second locking feature 326 engage with the rear surface 406 of the first flange 402 of the housing 102. The rear surface 406 of the first flange 402 engaging with the locking surfaces 338, 348 of the first and second locking features 324, 326 maintains a position of the mounting clip 104 relative to the panel 106.

In response to the clip 104 moving by sliding in the direction 502, the latching tabs 412 of the housing 102 interfere with the first and second locking features 324, 326. Additionally, the blocking tabs 414 may maintain a vertical position of the mounting clip 104 as the clip 104 moves in the direction 502. The latching tabs 412 interfering with the first and second locking features 324, 326 cause the body 118 of the mounting clip 104 to flex outward in a direction away from the passage 302. For example, the body 118, including the first and second sides 304, 306, expand or flex outward from the passage 302 in order to increase a width of the passage 302 between the first and second locking features 324, 326. When the clip 104 is in the locked position, the latching tabs 412 are disposed within the first and second pockets 334, 336 and the body 118 of the mounting clip 104 returns to an unflexed state. Additionally, when the clip 104 is in the locked position, the blocking tabs 414 engage with a top surface of the alignment notch 333 such that the top surface of the alignment notch 333 prevent movement of the mounting clip 104 in the direction 504.

The latching tabs 412 of the housing 102 engage with the first and second pockets 334, 336, respectively, of the first and second locking features 324, 326 when the mounting clip 104 is in the locked position. For example, the latching tabs 412 extend into the first and second pockets 334, 336 and maintain a position of the mounting clip 104. The first electrical connector 120 is assembled to the mating end 126 of the housing 102 in the locking operation and prevents the mounting clip 104 from disengaging from the housing 102. For example, the alignment notch 432 of the housing 102 latch onto one or more reciprocating latching features of the first electrical connector 120 and secure the components of the electrical assembly 100 together. Optionally, the housing 102 and/or the mounting clip 104 may have any alternative locking or latching mechanism that prohibits the mounting clip 104 from moving from the locking position to the unlocking position. Additionally, the anti-rotation feature 330 of the mounting clip 104 receives a protrusion of the housing (not shown) when the mounting clip 104 is in the locked position. The anti-rotation feature 330 prevents the mounting clip 104 and/or the housing 102 to rotate in a direction about the mating axis 140 of the housing 102.

Figure 7:
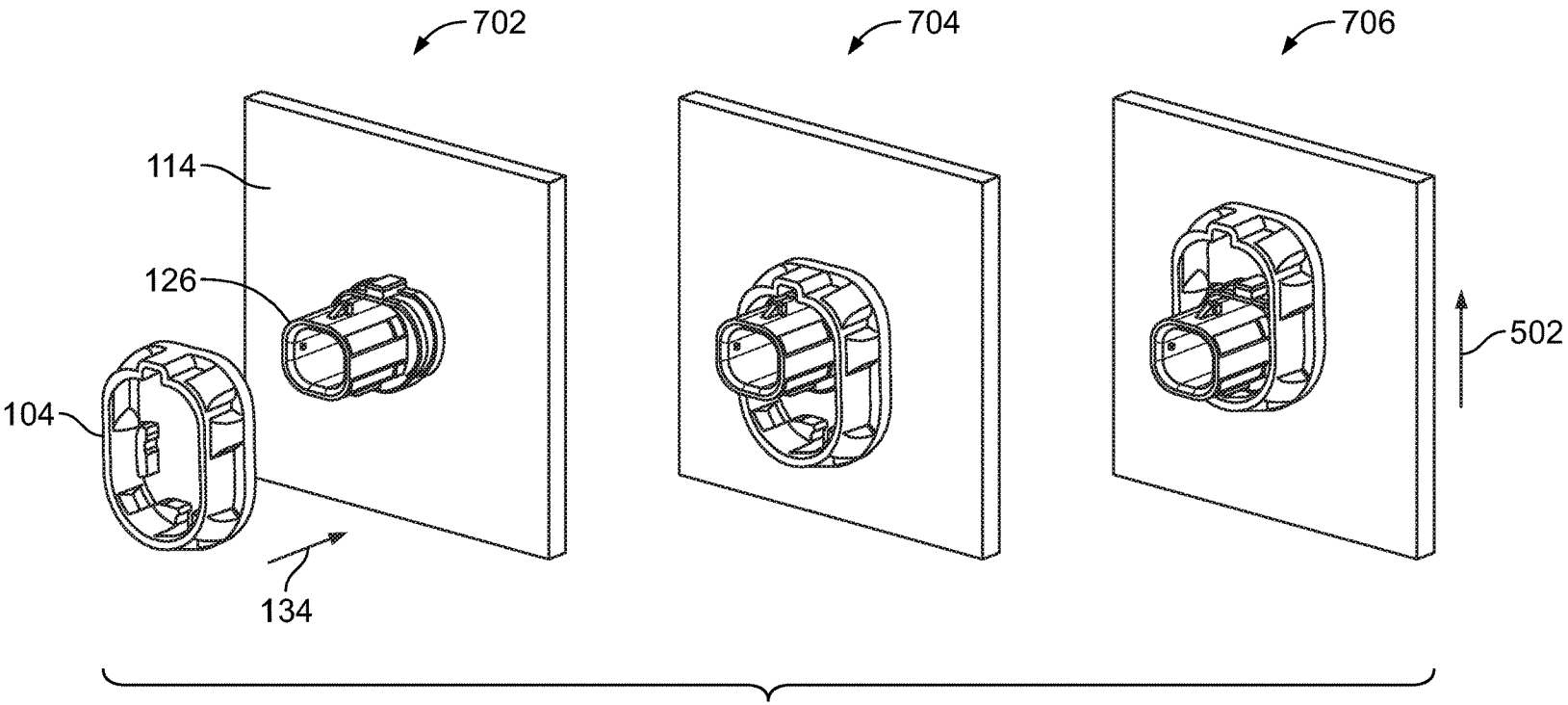
FIG. 7 is an illustrates a method of securing a housing to a panel with a mounting clip in accordance with an exemplary embodiment.

FIG. 7 is an illustration method of securing the housing 102 to the panel 106 with the mounting clip 104. At 702, the mating section 446 of the housing 102 extends through the opening 116 of the panel 106 such that the mating end 126 extends a distance away from the rear side 114 of the panel 106. The mounting clip 104 moves in the mounting direction 134 in order to be operably coupled with the mating end 126 of the housing 102. The mating end 126 of the housing 102 extends through the passage 302 of the clip 104.

At 704, the mounting clip 104 is in the unlocked position such that the mounting clip 104 may move in a direction opposite the mounting direction 134 and away from the panel 106. Additionally, in the unlocked position, the housing 102 may move in the mounting direction 134 and away from the front side 112 of the panel 106. In the unlocked position, the alignment notch 332 of the mounting clip 104 is aligned with and receives the alignment notches 432, 434 of the housing 102 to orient the mating end 126 of the housing 102 inside the passage 302 of the clip 104.

At 706, the mounting clip is moved from the unlocked position to the locked position by sliding the rear end 124 of the mounting clip 104 in the direction 502 along the rear side 114 of the panel 106. As the mounting clip 104 moves in the direction 502, the top or locking surfaces 338, 348 of the first and second locking features 324, 326 engage with and slide along the rear surfaces 406 of the first flange 402 of the housing 102. Additionally, the latch tabs 412 engage with the locking features 324, 326 and flex the body 118 of the mounting clip 104 outwardly. When the clip 104 is in the locked position, the latching tabs 412 engage with the first and second pockets 334, 336, respectively, of the first and second locking features 324, 326. When the mounting clip 104 is in the locked position, the blocking tabs 414 engage with the top surface of the alignment notch 333 and the anti-rotation feature 330 engages with a protrusion (not shown) at the bottom side 426 of the housing 102.

The latching tabs 412 received within the pockets 334, 336 of the locking features 324, 326 maintains a position of the mounting clip 104 in the locked position. When the mounting clip 104 is in the locked position and the first electrical connector 120 is assembled to the mating end 126 of the housing 102, the mounting clip 104 cannot disengage from the housing 102. The second electrical connector 130 is assembled to the receiving end 128 of the housing 102 to electrically couple the second electrical connector 130 with the first electrical connector 120. For example, the first electrical connector 120 prevents the mounting clip 104 from moving in the direction 504 (e.g., to the unlocked position), prevents the mounting clip 104 from moving in the loading direction 132 (of FIG. 2) away from the rear side 114 of the panel 106, and prevents the housing 102 from moving in the mounting direction 134 (of FIG. 2) away from the front side 112 of the panel 106. Alternatively, when the first electrical connector 120 is disassembled from the mating end 126 of the housing 102, the mounting clip 104 can move in the direction 504 (e.g., to the unlocked position), to mounting clip 104 may move in the loading direction 132 (of FIG. 2), and the housing 102 may move in the mounting direction 134 (of FIG. 2) away from the rear side 114 of the panel 106.

In the illustrated embodiment, the latching tabs 412 engaging with the pockets 334, 336 provide an engagement force that is substantially equivalent to a disengagement force. For example, the latching features of the mounting clip 104 and corresponding latching features of the housing 102 are shaped and sized such that an engagement force to hold the mounting clip 104 in the locked position is substantially similar to a disengagement force to move the mounting clip 104 from the locked position to the unlocked position. For example, when the first electrical connector 120 is not coupled with the housing 102, the mounting clip 104 can engage and disengage (e.g., move between the locked and unlocked positions) with approximately the same or substantially the same amount of force. In alternative embodiments, the latching features of the mounting clip 104 and the corresponding latching features of the housing 102 may be shaped such that the mounting clip 104 moves between the locked and unlocked positions with different forces. For example, an engagement force to hold the mounting clip 104 in the locked position may be greater or less than a disengagement force to move the mounting clip 104 from the locked position to the unlocked position.

Figure 8:
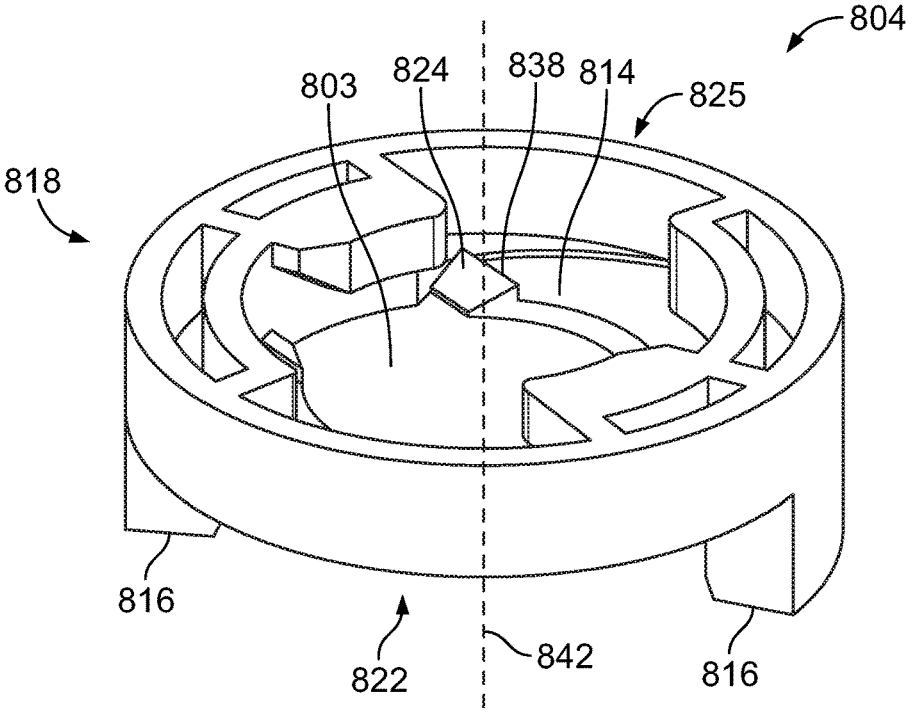
FIG. 8 is a bottom perspective view of a mounting clip in accordance with an exemplary embodiment.

FIG. 8 is a bottom perspective view of a mounting clip 804 in accordance with an exemplary embodiment. The mounting clip 804 is similar to the mounting clip 104 shown in FIG. 1, however the mounting clip 804 is coupled to a corresponding housing 802 (shown in FIG. 9) by rotating rather than sliding to a locked position. The mounting clip 804 includes a body 818 that extends between a front end 822 and a rear end 825 with a passage 803 extending therethrough along a clip axis 842. In the illustrated embodiment, the body 818 of the mounting clip 804 has a substantially circular cross-sectional shape with bosses 816 that extend a distance away from the front end 822 of the clip 804. Optionally, the mounting clip 804 may have any alternative shape and/or size.

The mounting clip 804 includes flex arms 814 that is disposed between the front end 822 and the rear end 825 of the body 818. In the illustrated embodiment of FIG. 8, the body 818 includes two flex arms 814 that define the passage 803 between the front and rear ends 822, 825. Optionally, the mounting clip 804 may include any number of flex arms. Each of the flex arms 814 includes a locking feature 824 that extends away from the flex arm 814. The locking feature 824 includes a locking surface 838 that extends from the flex arm 814 in a direction towards the rear end 825 of the clip 804.

In an alternative embodiment, the mounting clip 804 may not include any flex arms and the mounting clip 804 may instead be shaped and sized such that the body 818 of the mounting clip 804 may flex or bend. Additionally, the mounting clip 804 may include one or more load distributors (not shown) that may substantially evenly distribute the bending or flexing forces exerted onto the body 818 of the mounting clip 804 around the perimeter of the mounting clip 804.

Figure 9:
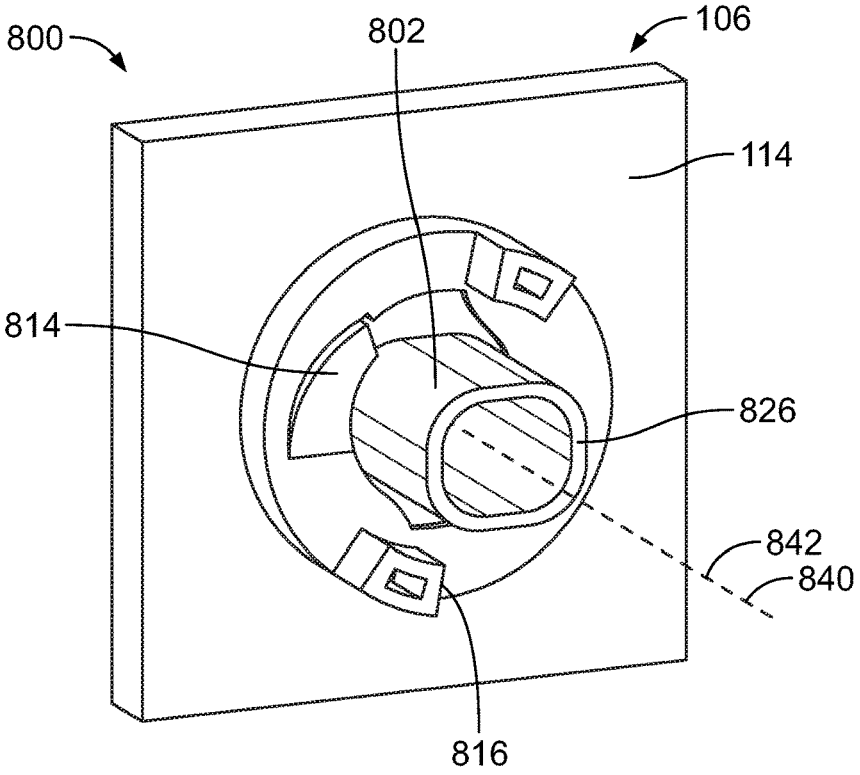
FIG. 9 is a perspective side view of an electrical assembly in accordance with an exemplary embodiment.

FIG. 9 is a perspective side view of an electrical assembly 800 in accordance with an exemplary embodiment. A mating end 826 of a housing 802 extends through the opening of the panel 106 from the front side 112 of the panel 106 to the rear side 114 of the panel 106. The mounting clip 804 is coupled with the mating end 826 of the housing 802. For example, the clip axis 842 is axially aligned with a mating axis 840 of the housing 802 and the rear end 825 of the mounting clip 804 is coupled with the rear side 114 of the panel 106.

The mounting clip 804 is moveable between an unlocked position and a locked position by sliding the rear end 825 of the clip 804 along the rear side 114 of the panel 106. In the illustrated embodiment, the mounting clip 804 moves between the unlocked position and the locked position by rotating the clip 804 about the clip axis 842 in a single or common plane. For example, the mounting clip 804 may move between the unlocked and locked positions about the clip axis 842 without moving between two or more different planes as the clip 804 rotates (e.g., in a non-helical path). In one or more embodiments, the mounting clip 804 may be moved between the unlocked and locked positions without disrupting a position of the mating housing 802 and/or while reducing an amount of stress that may be applied onto a solder joint of the housing 802 by the rotation of the mounting clip 804. Additionally or alternatively, the mounting clip 804 may move between the unlocked and locked positions when the clip axis 842 is not aligned with the mating axis 840.

The mounting clip 804 may be rotated by the geometry of the bosses 816 that extend from the front end 822 of the clip 804. Optionally, the mounting clip 804 may include bosses 816 having alternative geometry. In alternative embodiments, the bosses 816 may be omitted from the mounting clip 804 and the mounting clip 804 may be rotated using a tool or an alternative feature of the mounting clip 804. The locking feature 824 of the mounting clip 804 engages with one or more tabs, flanges, or the like, of the housing 802 (not shown) as the mounting clip 804 rotates to move between the unlocked position and the locked position. As a result of the locking feature 824 engaging with one or more features of the housing 802, the flex arm 814 of the clip 804 flexes outward and in a direction towards the front end 822 of the clip 804 to allow the locking feature 824 to bypass the housing 802 as the mounting clip 804 is moved between the unlocked position and the locked position.

When the mounting clip 804 is in the locked position, the locking surface 838 of the locking feature 824 engages with a surface or feature of the housing 802 and prevents the mounting clip 804 from moving to the unlocked position. For example, the locking feature 824 secures the mounting clip 804 to the housing 802 and secures the housing 802 to the panel 106. Additionally, the locking feature 824 prevents the mounting clip 804 from rotating in a direction to the unlocked position, prevents the mounting clip 804 from moving in a direction away from the rear side 114 of the panel 106, and prevents the housing 802 from moving in a direction away from the front side 112 of the panel 106. Optionally, the engagement of an electrical connector (e.g., first electrical connector 120) may prevent the mounting clip 104 from rotating in a direction to the unlocked position and may prevent the mounting clip 804 from moving in a direction away from the rear side 114 of the panel 106.

In one or more embodiments, the mounting clip 804 and/or the housing 802 may have one or more alignment notches or features that may align the mounting clip 804 with the housing 802 when the mounting clip 804 is coupled with the housing 802 in the unlocked position. Optionally, the mounting clip 804 may include one or more load distributors or features that may increase the robustness of the clip 804. Optionally, the clip 804 may move in two or more directions between the unlocked position and the locked position. For example, the mounting clip may move by sliding the mounting clip from a first or unlocked position to a second position, and then may move by rotating the mounting clip from the second position to a third position or locked position. Optionally, the mounting clip 804 may have any number of flex arms and/or locking features that may engage with the housing 802 to secure the housing 802 to the panel 106 and to secure the mounting clip 804 to the housing 802.

Figure 10:
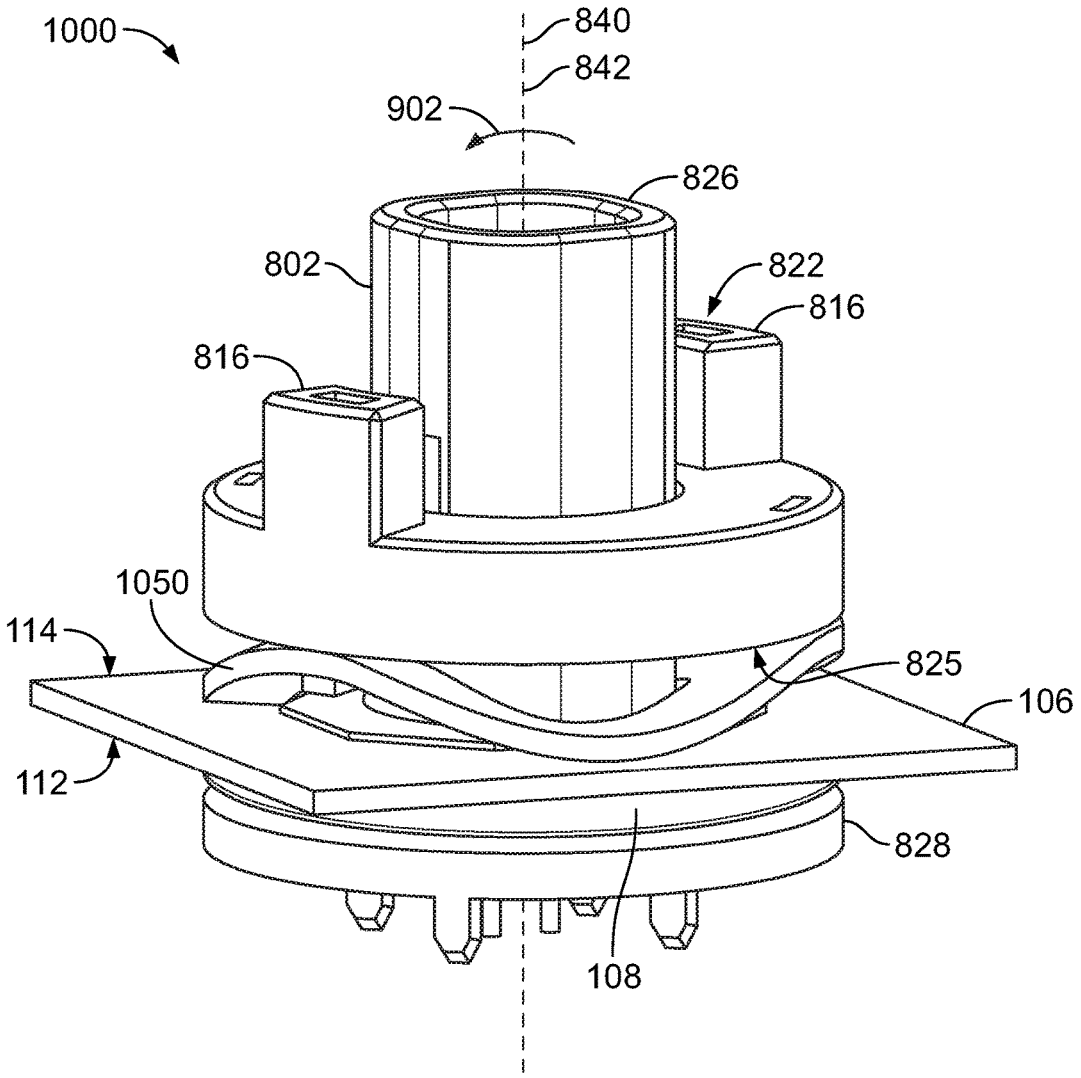
FIG. 10 is a perspective view of an electrical assembly in accordance with an exemplary embodiment.

FIG. 10 is a perspective view of an electrical assembly 1000 in accordance with an exemplary embodiment. The electrical assembly 1000 includes the mounting clip 804 that is coupled with the housing 802 and that rotates about the mating axis 840 and the clip axis 842 to move the mounting clip 804 between the unlocked and the locked positions. The electrical assembly 1000 also includes a spring 1050 disposed at the rear end 825 of the mounting clip 804. In the illustrate embodiment, the spring 1050 is a wave spring that extends around the passage 803 of the mounting clip 804 and engages with the rear side 114 of the panel 106. The spring 1050 is compressible between the rear end 825 of the mounting clip 804 and the rear side 114 of the panel 106 to bias the mounting clip 804 away from the panel 106. The spring 1050 may be assembled with or attached to the mounting clip 804 by a snap assembly, overmolding, riveting, heat staking, or the like. Optionally, the spring 1050 may be a leaf spring, a standard spring, a compression spring, a tension spring, or the like. In one or more embodiments, the electrical assembly 1000 may include two or more springs 1050 disposed at the rear end 825 of the clip 804. In an exemplary embodiment, one or more springs may be coupled with a mounting clip that moves in a linear direction (e.g., the mounting clip 104).

At least one technical effect of the electrical assembly described herein is a versatile mounting clip that has the ability to secure a housing to a panel. The body of the mounting clip, rather than cantilevered latches of known mounting clips, flexes thereby improving the robustness of the mounting clip. The electrical assembly also provides additional configuration flexibility by allowing the mounting clip to slide in different directions (translating, rotating, or the like) to secure the housing to the panel. Another technical effect of the electrical assembly is a reduced footprint on the panel, relative to known mounting clips, thereby minimizing an overall package size of the electrical assembly. Additionally, the additional configuration flexibility allows the mounting clip to secure the housing to different panels having different thicknesses from each other.

As used herein, relative or spatial terms such as "upper," "lower," "inner," "outer," "front," and "back" are only used to distinguish the referenced elements and do not necessarily require particular positions or orientations relative to gravity and/or the surrounding environment of the electrical assembly 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical assembly comprising:

a housing configured to be disposed on a front side of a panel, the housing including a housing body that extends along a mating axis between a mating end and a receiving end, wherein the mating end is configured to extend through an opening of the panel from the front side of the panel to an opposite rear side of the panel; and a mounting clip coupled to the housing, the mounting clip including a body extending between a front end and a rear end, the body having a passage therethrough configured to receive the mating end of the housing, the body including a first side and a second side defining the passage, the first side having a locking feature extending therefrom into the passage, wherein the mounting clip is moveable between an unlocked position and a locked position by sliding the rear end of the mounting clip adjacent the rear side of the panel, the body being flexed outward to allow the locking feature to bypass the housing as the mounting clip is moved between the unlocked position and the locked position, wherein the mating end of the housing is configured to be coupled with an electrical connector on the rear side of the panel, wherein the electrical connector engages the housing in a locking operation when the mounting clip is moved into a locked position to secure the housing to the panel, wherein the electrical connector is configured to secure the mounting clip in the locked position.

2. The electrical assembly of claim 1, wherein the body of the mounting clip is configured to flex when the mounting clip moves between the unlocked position and the locked position responsive to the locking feature engaging with the mating end of the housing.

3. The electrical assembly of claim 1, wherein the housing includes a latching tab, wherein the locking feature includes a pocket configured to receive the latching tab when the mounting clip is in the locked position.

4. The electrical assembly of claim 1, wherein the mounting clip is configured to move between the unlocked position and the locked position within a single plane.

5. The electrical assembly of claim 1, wherein the housing includes a flange, wherein the flange is configured to engage with a locking surface of the locking feature to secure the housing to the panel.

6. The electrical assembly of claim 1, wherein the mounting clip is configured to rotate about the mating axis or translate in a direction substantially perpendicular to the mating axis when the mounting clip moves between the unlocked position and the locked position.

7. The electrical assembly of claim 1, further comprising a spring disposed at the rear end of the mounting clip, wherein the spring is compressible between the rear end of the mounting clip and the rear side of the panel to bias the mounting clip away from the panel.

8. The electrical assembly of claim 1, wherein the body of the mounting clip includes an interior surface defining the passage, wherein the locking feature extends into the passage and away from the interior surface.

9. The electrical assembly of claim 1, wherein the mounting clip includes an anti-rotation feature configured to engage the housing when the mounting clip is in the locked position.

10. The electrical assembly of claim 1, wherein the locking feature is a first locking feature at the first side, the mounting clip further comprising a second locking feature at the second side extending therefrom into the passage.

11. The electrical assembly of claim 10, wherein the body is configured to flex outward to allow the first locking feature and the second locking feature to bypass the housing as the mounting clip is moved between the unlocked position and the locked position.

12. The electrical assembly of claim 1, wherein the body of the mounting clip includes a ring at the front end and a flange at the rear end extending from the ring.

13. The electrical assembly of claim 12, wherein the body includes one or more load distributors extending between the ring and the flange.

14. A mounting clip for securing a housing to a panel, the mounting clip comprising:

a body including a front end and a rear end with a passage extending therebetween, the body having a first side and a second side, wherein the body of the mounting clip includes a ring at the front end and a flange at the rear end extending from the ring;

a first locking feature extending from the first side of the body into the passage; and a second locking feature extending from the second side of the body into the passage, wherein the mounting clip is moveable between an unlocked position and a locked position by sliding the rear end of the mounting clip adjacent the panel, wherein the first and second locking features engage the housing in the locked position to secure the housing to the panel, the body being flexed outward to allow the first locking feature and the second locking feature to bypass the housing as the mounting clip is moved between the unlocked position and the locked position.

15. The mounting clip of claim 14, wherein the rear end of the mounting clip includes a spring, wherein the spring is compressible between the rear end of the mounting clip and the panel to bias the mounting clip away from the panel.

16. The mounting clip of claim 14, wherein the body includes one or more load distributors extending between the ring and the flange.

17. The mounting clip of claim 14, wherein the body of the mounting clip includes an interior surface defining the passage, wherein the first locking feature and the second locking feature extend into the passage from the interior surface.

18. The mounting clip of claim 14, further comprising an anti-rotation feature, wherein the anti-rotation feature extends into the passage and is configured to engage the housing when the mounting clip is in the locked position.

19. An electrical assembly comprising:

a housing configured to be disposed on a front side of a panel, the housing including a housing body that extends along a mating axis between a mating end and a receiving end, wherein the mating end is configured to extend through an opening of the panel from the front side of the panel to an opposite rear side of the panel, the housing also including a first latching tab and a second latching tab;

a mounting clip coupled to the housing, the mounting clip including a body extending between a front end and a rear end, the body having a passage therethrough configured to receive the mating end of the housing, the body including a first side and a second side, the first side having a first locking feature extending therefrom into the passage, wherein the first locking feature includes a first pocket, the second side having a second locking feature extending therefrom into the passage, wherein the second locking feature includes a second pocket, wherein the mounting clip is moveable between an unlocked position and a locked position by sliding the rear end of the mounting clip adjacent the rear side of the panel in a single plane, the body being flexed outward to allow the first locking feature and the second locking feature to bypass the housing as the mounting clip is moved between the unlocked position and the locked position; and an electrical connector configured to be coupled with the mating end of the housing on the rear side of the panel, wherein the electrical connector engages the housing in a locking operation when the mounting clip is moved into a locked position to secure the housing to the panel, wherein the electrical connector is configured to secure the mounting clip in the locked position.

* * * * *